US009423774B2

(12) United States Patent
Yamakawa

(10) Patent No.: US 9,423,774 B2
(45) Date of Patent: Aug. 23, 2016

(54) ELECTRONIC TIMEPIECE INCLUDING LIGHT EMITTING SECTION

(71) Applicant: CASIO COMPUTER CO., LTD., Shibuya-ku, Tokyo (JP)

(72) Inventor: Eiji Yamakawa, Tama (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/727,510

(22) Filed: Jun. 1, 2015

(65) Prior Publication Data

US 2015/0378319 A1 Dec. 31, 2015

(30) Foreign Application Priority Data

Jun. 27, 2014 (JP) ..... 2014-132495

(51) Int. Cl.
*G04G 9/00* (2006.01)
*G04C 3/14* (2006.01)
*G04B 19/30* (2006.01)

(52) U.S. Cl.
CPC ..... *G04G 9/0017* (2013.01); *G04B 19/30* (2013.01); *G04C 3/14* (2013.01)

(58) Field of Classification Search
CPC ..... G04C 3/14; G04C 3/143; G04C 3/146; G04C 17/00; G04C 10/02; G04G 17/02; G04G 19/02; G04G 9/0017; G04B 19/30
USPC ..... 368/75, 80, 82, 83, 205
See application file for complete search history.

(56) References Cited

U.S. PATENT DOCUMENTS 5,008,865 A * 4/1991 Shaffer ..... G04G 11/00 315/194
5,243,568 A * 9/1993 Burch ..... G04G 13/028 368/245
5,359,577 A * 10/1994 Hoshino ..... G04B 19/30 368/67
5,457,664 A * 10/1995 Izukawa ..... G04G 19/12 368/203
5,886,954 A * 3/1999 Asami ..... G04B 19/30 368/227
6,236,622 B1 * 5/2001 Blackman ..... G04B 47/00 362/253
2003/0231553 A1 * 12/2003 Kibiloski ..... G04G 9/0041 368/67
2004/0008588 A1 * 1/2004 Minami ..... G04B 19/10 368/205
2006/0058926 A1 * 3/2006 Abbott ..... G04C 10/02 701/1
2008/0192582 A1 * 8/2008 Spoto ..... G04G 7/00 368/76
2009/0285056 A1 * 11/2009 Scott ..... G04G 21/04 368/21
2010/0061193 A1 * 3/2010 Kasuo ..... G04C 10/02 368/204
2010/0278016 A1 * 11/2010 Sandu ..... A61M 21/00 368/10
2011/0182151 A1 * 7/2011 Geyer ..... G04G 9/0017 368/11
2012/0057438 A1 * 3/2012 Shimizu ..... G04C 10/02 368/204

FOREIGN PATENT DOCUMENTS

JP 2004053381 A 2/2004

* cited by examiner

*Primary Examiner* — Amy Cohen Johnson
*Assistant Examiner* — Matthew Powell
(74) *Attorney, Agent, or Firm* — Holtz, Holtz & Volek PC

(57) ABSTRACT

An electronic timepiece includes a display section which displays time information and a light emitting section which illuminates a display surface of the display section by emitting light. A light emitting control section performs control to turn on the light emitting section by gradually increasing a light emitting amount of the light emitting section to a peak value in a predetermined brightening time according to a predetermined light emitting condition.

9 Claims, 5 Drawing Sheets

ELECTRONIC TIMEPIECE INCLUDING LIGHT EMITTING SECTION

BACKGROUND OF THE INVENTION

1. Field of the Invention

The present invention relates to an electronic timepiece including a light emitting section.

2. Description of Related Art

Conventionally, there have been electronic timepieces which include illumination functions of illuminating display surfaces so that users can surely confirm time and various types of information visually in dark places such as outdoors and bed rooms at night. Such electronic timepieces have configurations for detecting user's operations and turning on light emitting elements for predetermined periods of time, the user's operations including pressing of predetermined push button switches and inclination of wristwatches at predetermined angles in dark places where light amounts detected by light amount sensors are predetermined reference values or less.

As a technique for improving visibility by such illumination functions, Japanese Patent Laid-Open Publication No. 2004-53381 discloses a technique of efficiently illuminating an entire display surface by providing a frame-like light-permeable member which has fine irregularities on the outer circumference of the display surface, reflecting and diffusing, with the fine irregularities, light emitted from a light emitting element which is provided inside the light-permeable member, and generating circular illumination.

However, light emitting elements having higher brightness have been used in recent years, and there has been a problem that user's visibility is disturbed since the user feels the light dazzling when such light emitting elements are suddenly turned on in dark places.

SUMMARY OF THE INVENTION

An object of the present invention is to provide an electronic timepiece which is gentle to user's eyes and can ensure good visibility.

In order to achieve the above object, according to one aspect of the present invention, there is provided an electronic timepiece, including: a display section which displays time information; a light emitting section which illuminates a display surface of the display section by emitting light; and a light emitting control section which performs control to turn on the light emitting section by gradually increasing a light emitting amount of the light emitting section to a peak value in a predetermined brightening time according to a predetermined light emitting condition.

BRIEF DESCRIPTION OF THE DRAWINGS

The above and other objects, advantages and features of the present invention will become more fully understood from the detailed description given hereinafter and the appended drawings which are given byway of illustration only, and thus are not intended as a definition of the limits of the present invention, and wherein.

DETAILED DESCRIPTION OF THE PREFERRED EMBODIMENT

Hereinafter, an embodiment of the present invention will be described on the basis of the drawings.

Figure 1:
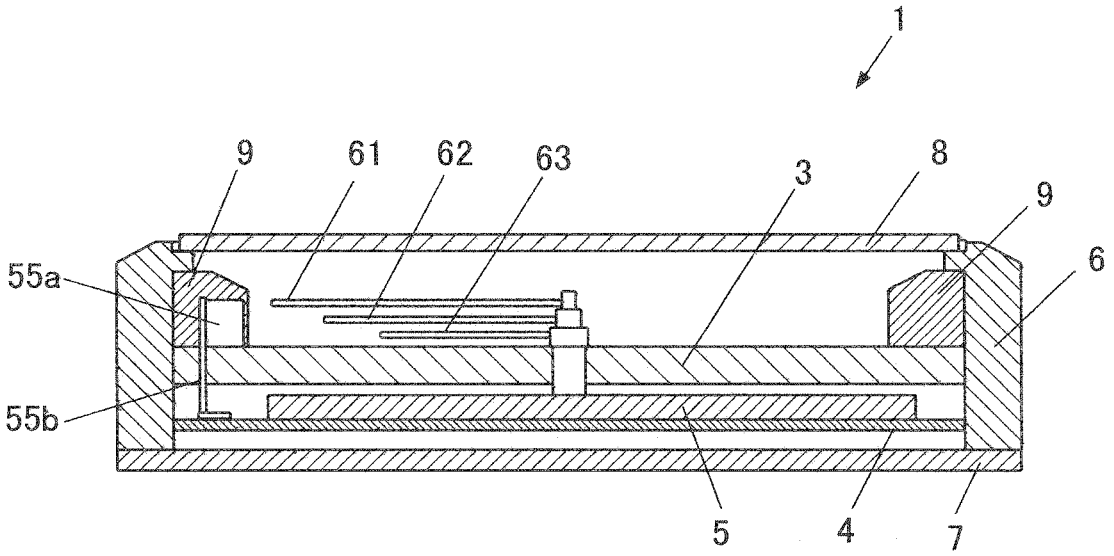
FIG. 1 is a sectional view of an electronic timepiece in an embodiment.

FIG. 1 is a sectional view of an electronic timepiece 1 in the embodiment of the present invention.

The sectional view shows a cross section which is through the center of the electronic timepiece 1 and orthogonal to the display surface.

The electronic timepiece 1 is an analog electronic timepiece which rotates a plurality of hands 61 to 63 and displays date and time.

The electronic timepiece 1 includes an annular frame 6; an annular parting plate 9 which contacts the inner wall of the frame 6; a face 3; a second hand 61, a minute hand 62 and an hour hand 63 (hereinafter, also referred to as hands 61 to 63 together) which are provided so as to be rotatable on the display surface of the face 3; a transparent watch glass 8 which covers the display surface of the face 3 and the hands 61 to 63; a substrate 4 and a module 5 which are provided at the opposite side of the display surface of the face 3; a back cover 7 which contains therein the substrate 4 and the module 5 together with the frame 6; a light emitting element 55*a* (light emitting section); a wiring 55*b* and such like.

Various scales and marks for the hands 61 to 63 to indicate time and various types of information are provided on the display surface side of the face 3.

The face 3 is also provided with a solar panel to generate electric power according to the amount of incident light.

The face 3 and the hands 61 to 63 form a display section.

The substrate 4 is provided with various electronic components and electronic circuits according to operations of the electronic timepiece 1.

The electric power is supplied from the solar panel, a secondary cell and such like to the substrate 4 to control various operations, count time and store setting data and such like.

The module 5 includes various configurations according to hand operations, the secondary cell of a power supply section 50 (see FIG. 2) and such like, and the module 5 is disposed at an appropriate position.

The module 5 is connected to the substrate 4 via a wiring (not shown in the drawings) to input control signals and input/output the electric power.

The light emitting element 55*a* is provided in the concave portion provided on the inner lateral surface of the annular parting plate 9, and illuminates the hands and face 3 from a lateral side.

An LED (Light Emitting Diode) is used as the light emitting element 55*a*, for example.

The concave portion and the light emitting element 55*a* are provided in the 6 o'clock side of the face 3 though the positions thereof are not especially limited.

The light emitting element 55*a* is connected to the substrate 4 via the wiring 55*b*, and emits light at the light amount corresponding to the current-carrying state of the wiring 55*b*.

Figure 2:
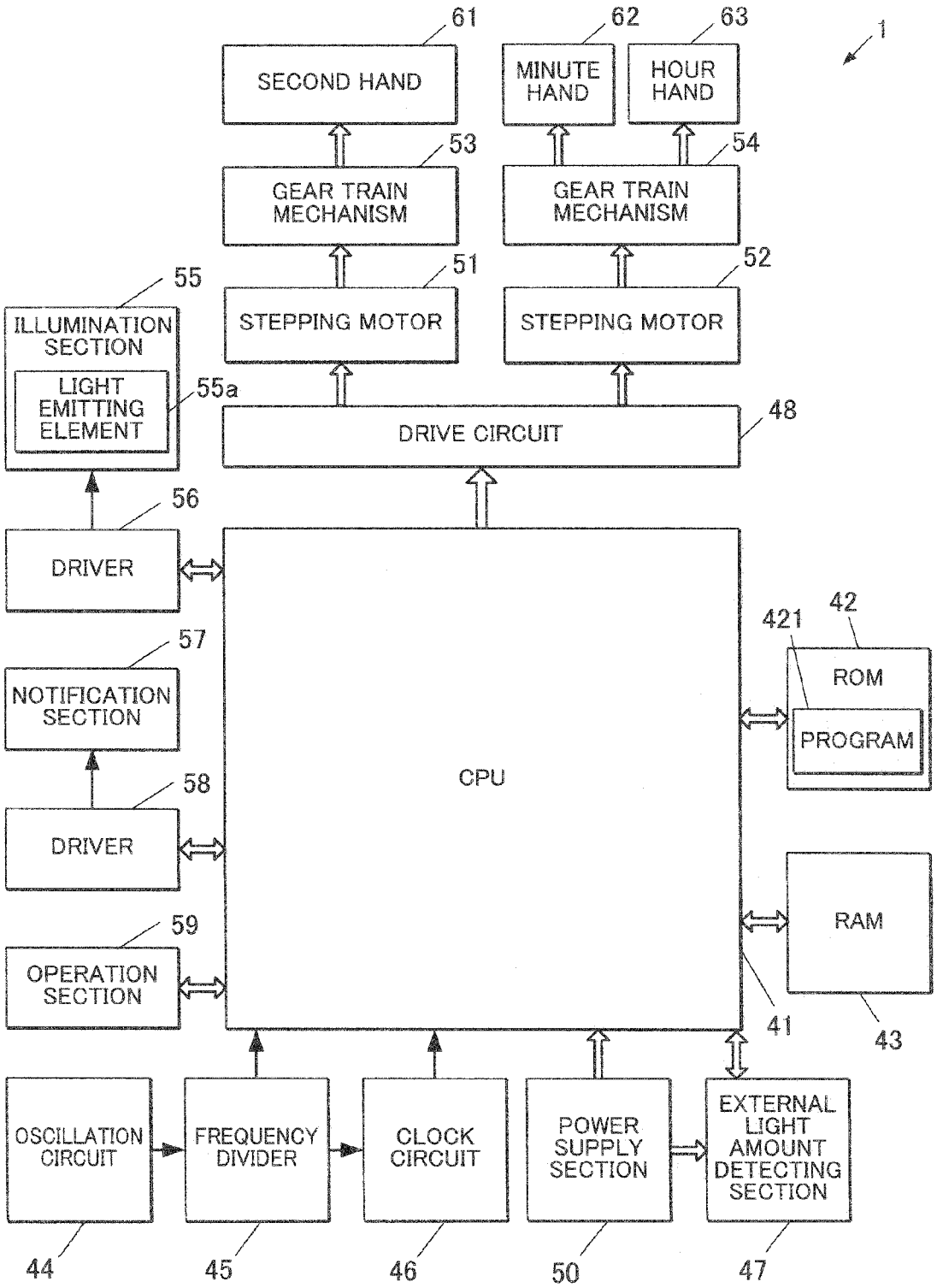
FIG. 2 is a block diagram showing a functional configuration of the electronic timepiece.

FIG. 2 is a block diagram showing a functional configuration of the electronic timepiece 1 in the embodiment of the present invention.

The electronic timepiece 1 includes a CPU 41 (Central Processing Unit) (light emitting control section), a ROM 42 (Read Only Memory), a RAM 43 (Random Access Memory), an oscillation circuit 44, a frequency divider 45, a clock circuit 46, an external light amount detecting section 47 (external light detecting section), a drive circuit 48 (operation detecting section and drive control section), a power supply section 50, an illumination section 55, a driver thereof 56, a notification section 57, a driver thereof 58, an operation section 59, stepping motors 51 and 52, gear train mechanisms 53 and 54, a second hand 61, a minute hand 62, an hour hand 63 and such like.

The CPU 41 performs various types of arithmetic processing and integrally controls the entire operation of the electronic timepiece 1.

The CPU 41 loads a control program read out from the ROM 42 into the RAM 43 and performs processing according to various operations such as time display and counting and display of stopwatch.

The ROM 42 is a mask ROM, a rewritable non-volatile memory or the like and stores control programs and initial setting data which are stored in advance.

The control programs include an illumination control program 421 to perform various types of control processing according to on/off of lighting of the illumination section 55.

The RAM 43 is a volatile memory such as a SRAM and a DRAM, stores temporal data by providing a memory space for working to the CPU 41 and stores various types of setting data.

The oscillation circuit 44 generates and outputs predetermined frequency signals.

A crystal oscillator is used as the oscillation circuit 44, for example.

The frequency divider 45 divides the frequency signals input from the oscillation circuit 44 into frequency signals used by the clock circuit 46 and the CPU 41, and outputs the signals.

The frequency of the output signals may be changeable on the basis of the setting by the CPU 41.

The signals may also be directly output maintaining the frequency thereof in the oscillation circuit 44.

The clock circuit 46 counts the current date and time by counting the number of input signals and adding the number to an initial value.

The clock circuit 46 may change the value to be stored in the RAM by software, or may include a dedicated counter circuit.

The drive circuit 48 outputs pulses of drive voltage waveform (drive pulses) at an appropriate timing and width to the stepping motors 51 and 52 on the basis of control signals input from the CPU 41 to move the hands 61 to 63.

The drive circuit 48 can change the pulse width of drive pulse according to the state of electronic timepiece 1 and such like.

When a control signal to drive a plurality of hands at the same time is input, the drive circuit 48 can slightly shift the respective output timings of drive pulses so as to reduce the load peak.

The stepping motor 51 rotates the second hand 61 via the gear train mechanism 53 disposing a plurality of gears. The stepping motor 52 rotates the minute hand 62 and the hour hand 63 in conjunction with each other via the gear train mechanism 54.

The numbers of rotation of the respective hands per step of the stepping motors 51 and 52 are determined by the arrangement of gears in the gear train mechanisms 53 and 54, respectively.

For example, here, the gear train mechanism 53 is configured so that the secondhand 61 is rotated 6 degrees per step of the stepping motor 51, and the gear train mechanism 54 is configured so that the minute hand 62 is rotated 1 degree per step of the stepping motor 52.

According to the configuration of the gear train mechanism 54, the hour hand 63 is rotated in conjunction with the minute hand 62 at the rotation angle of 1/12 with respect to the rotation of the minute hand 62.

Accordingly, the minute hand 62 makes one rotation on the display surface of the face 3 in 60 minutes by rotating 1 degree per 10 seconds, while the hour hand 63 rotates 30 degrees on the display surface of the face 3 in 60 minutes.

Then, the hour hand 63 makes one rotation on the display surface of the face 3 while the minute hand 62 makes 12 rotations in 12 hours.

The power supply section 50 supplies electric power according to the operation of the electronic timepiece 1 to the respective sections at a predetermined voltage.

Here, a solar battery and a secondary cell are used as the power supply section 50.

The solar panel of the face 3 generates an electromotive force by the incident light and supply the electric power to the sections such as the CPU 41. When excess electric power is generated, the electric power is charged in the secondary cell.

On the other hand, when the electric power which can be generated from the incident light amount from outside to the solar panel is less than the electric power to be consumed, the electric power is supplied from the secondary cell.

The power supply section 50 also supplies electric power directly to the illumination section 55 and the notification section 57 on the basis of the control signal from the CPU 41.

The external light amount detecting section 47 measures the amount of incident light to the solar panel.

The external light amount detecting section 47 obtains the incident light amount from the amount of electromotive force by the solar panel, for example, and outputs the measurement value as the detected light amount to the CPU 41 at a predetermined sampling rate.

Alternatively, the external light amount detecting section 47 may be configured to include one or a plurality of comparators to compare each reference voltage with the electromotive force by the comparator and output the voltage signal indicating the magnitude relation therebetween to the CPU 41.

The operation section 59 receives the input operation from user and outputs an electric signal corresponding to the input operation as an input signal to the CPU 41.

The operation section 59 includes push button switches and a crown switch, for example.

The notification section 57 performs a predetermined notification operation to the user such as generation of buzzer sound and vibration.

For example, the notification section 57 includes a piezoelectric element and a vibration plate, and can generate a beep sound by applying a voltage of a desired audible field frequency to the piezoelectric element via the driver 58 to vibrate the piezoelectric element.

Alternatively, the notification section 57 includes a weighted motor, for example, and can generate vibration by rotating the motor at a predetermined frequency.

As the driver 58, a driver corresponding to the configuration of notification section 57 which performs the above notification operation is provided and outputs a drive signal of a predetermined voltage or electric current to the notification section 57.

The illumination section 55 includes the light emitting element 55*a*, and illuminates the display surface of face 3 and the hands 61 to 63 by light emitting of the light emitting element 55*a*.

The driver 56 controls the output of electric power supplied from the power supply section 50 to the light emitting element 55*a* on the basis of the control signal from the CPU 41.

The driver 56 can vary the light emitting amount of light emitting element 55*a* in multiple levels by PWM (Pulse Width Modulation).

The maximum light emitting amount of the light emitting element 55*a* is determined by a resistance value of resistance element provided serially to the light emitting element 55*a* in the illumination section 55.

The control of illumination operation by the light emitting element 55*a* will be described in detail below.

The CPU 41, ROM 42, RAM 43, oscillation circuit 44, frequency divider 45, clock circuit 46, external light amount detecting section 47, drive circuit 48 and such like are provided as a one chip to the substrate 4, and the stepping motors 51 and 52, gear train mechanisms 53 and 54 and secondary cell of power supply section 50 are provided inside the module 5, for example.

The notification section 57 and the operation section 59 may be appropriately provided to positions appropriate for notification operation to the user and reception of user's operation, respectively.

Next, the illumination operation by the illumination section 55 will be described.

In the illumination section 55 of the embodiment, the power supply from the power supply section 50 is turned on and off by the control of the CPU 41, and thereby the on/off of lighting of the light emitting element 55*a* is controlled.

The illumination section 55 includes a switching element such as an FET in the power supply circuit from the power supply section 50 to the light emitting element 55*a*, for example.

The CPU 41 outputs a control signal for applying a predetermined on-voltage Von (for example, on-voltage Von>0 in a case of n-type FET) to the gate electrode of FET, thereby the electric current flows through the light emitting element 55*a*, and the light emitting element 55*a* emits light.

On the other hand, the electric current does not flow through the light emitting element 55*a* by the off-voltage Voff (off-voltage Voff=0 in a case of n-type FET) being output to the gate electrode of FET, and the light emitting element 55*a* is turned off.

Figure 3:
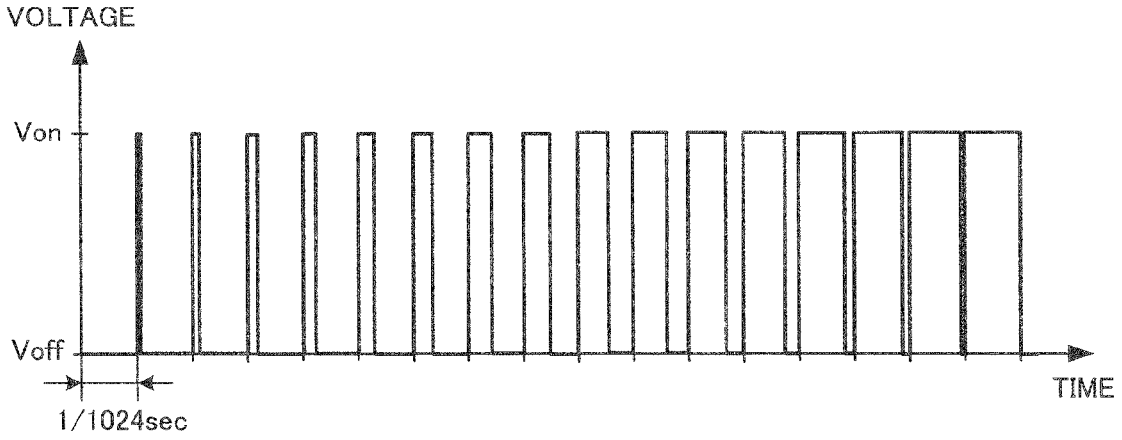
FIG. 3 is a view for explaining a light emitting pattern of light emitting element of an illumination section.

FIG. 3 is a view for explaining a light emitting pattern of the light emitting element 55*a* of the illumination section 55 in the electronic timepiece 1 of the embodiment.

The CPU 41 adjusts the light emitting amount per unit time by pulse width modulation (PWM) by varying the period of time for turning on the power supply, that is, the period of time for which the electric current flows through the light emitting element 55*a* (duty ratio) in 16 stages per 16 cycles 1/1024 seconds (unit time) on the basis of a clock signal input from the frequency divider 45, here, a 16.384 kHz signal, for example.

Accordingly, the unit time is appropriately determined in a range shorter than the time for which a person can perceive the blinking of ordinary light.

When the instruction to turn on the light emitting element 55*a* is obtained from the user's input operation to the operation section 59, the CPU 41 of the electronic timepiece 1 performs PWM control to gradually increase the light emitting amount of the light emitting element 55*a* to a predetermined maximum light emitting amount in a predetermined period of time.

After the light is emitted at the maximum light emitting amount over a preset duration time, the CPU 41 gradually decreases the light emitting amount of the light emitting element 55*a* to turn off the light in a predetermined period of time.

At this time, the predetermined period of time (brightening time) according to gradual increase in the light emitting amount when the light is turned on may be the same as or different from the predetermined period of time (darkening time) according to the gradual decrease of the light emitting amount when the light is turned off.

The pattern of gradual increase (gradual decrease) of the light emitting amount in the predetermined period of time may be appropriately set.

That is, the change rate of the duty ratio may be constant or may be varied at a predetermined pattern in the predetermined period of time.

Figure 4:
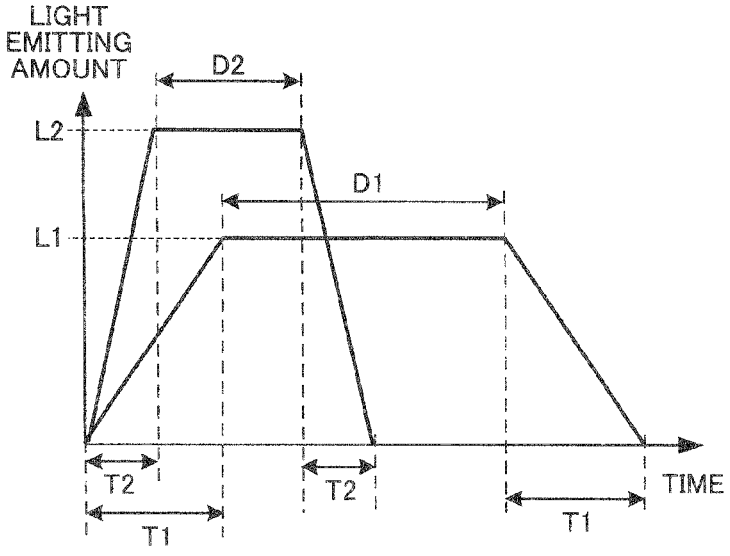
FIG. 4 is a view showing examples of transition in light emitting amount of the light emitting element.

FIG. 4 is a view showing transition examples of light emitting amount of the light emitting element 55*a*.

In one of the examples, the light emitting amount is gradually increased to the maximum light emitting amount L1 (peak value) in time T1 (brightening time) from the start of lighting operation by the CPU 41, the light is emitted at the maximum light emitting amount L1 over a duration time D1, and thereafter, the light emitting amount is gradually decreased to turn off the light in the time T1 (darkening time). In the other of the examples, the light emitting amount is gradually increased to the maximum light emitting amount L2 (>L1) in time T2 (<T1), the light is emitted at the maximum light emitting amount L2 (>L1) over duration time D2 (<D1), and thereafter the light emitting amount is gradually decreased to turn off the light in the time T2.

Such a plurality of patterns of light on/off controls may be automatically selected according to the condition (light emitting condition) and such like when light is turned on instead of being selected by user's setting in advance.

Here, either one is selected according to the incident light amount (detected light amount) detected by the external light amount detecting section 47.

For example, the setting can be such that, when a lighting instruction is obtained by the input operation to the operation section 59 by the user, if the light amount detected by the external light amount detecting section 47 at the present timing is a predetermined reference value or more, the maximum light emitting amount is set to be L2 and the duration time is set to be D2, and if the detected light amount is less than the reference value, the maximum light emitting amount is set to be L1 and the duration time is set to be D1.

Alternatively, as another example of selecting method (light emitting condition) for a plurality of patterns of light on/off controls, the setting can be such that, when a lighting instruction is obtained from the input operation to the operation section 59 by the user, the lighting pattern of maximum light emitting amount L1, duration time D1 and time T1 according to gradual increase/decrease is selected, and when the lighting instruction is obtained from an internal operation such as an alarm notification operation and a timer notification operation, a lighting pattern of the maximum light emitting amount L2, duration time D2 and time T2 according to gradual increase/decrease is selected.

The adjustment of light amount by PWM control may be temporarily interrupted.

Figure 5:
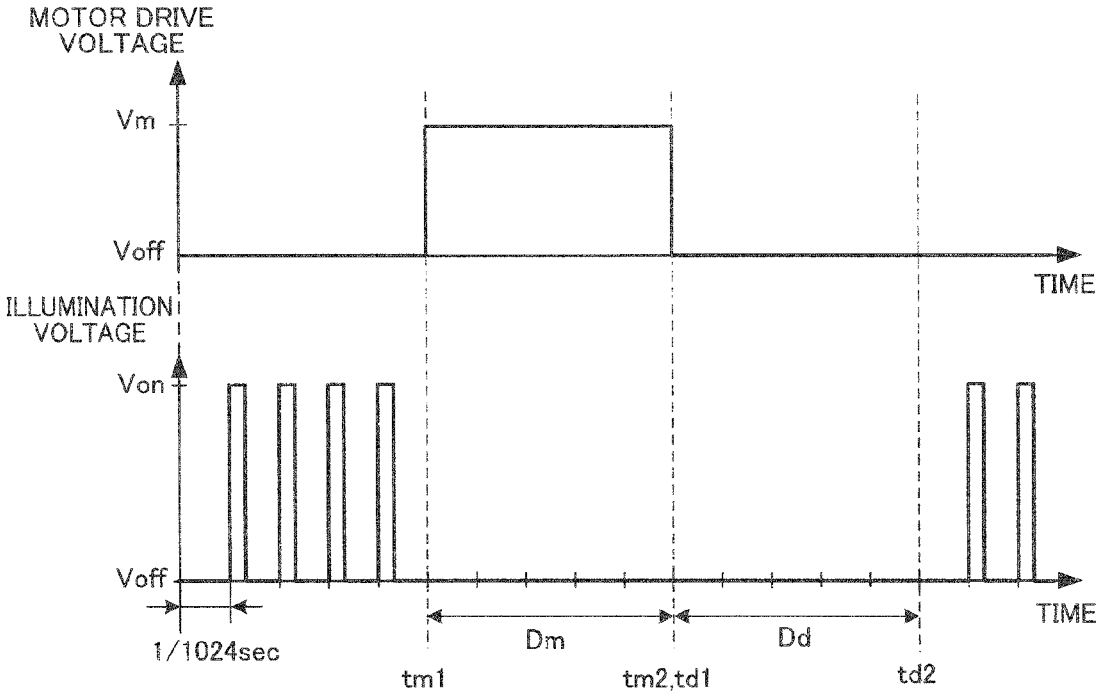
FIG. 5 is a view for explaining light emitting control when a hand is rotated.

FIG. 5 is a view for explaining light emitting control during hand rotation operation.

Here, the output of voltage pulse according to PWM control is stopped during a drive pulse output period Dm (voltage Vm) to output drive pulses to the stepping motors 51 and 52 and a predetermined waiting period Dd after the end of the drive pulse output period Dm.

The drive pulse output period Dm and the waiting period Dd are collectively called an operation period of stepping motors 51 and 52 (that is, hands 61 to 63).

In the PWM control, electromagnetic noise is generated due to the frequent change in voltage and electric current of circuit according to on/off of the power supply.

Since the stepping motors 51 and 52 control rotor's rotation by using magnetic field, it is preferable to reduce electromagnetic noise generated at close range.

In a case where rotation of the stepping motors 51 and 52 is detected in the electronic timepiece 1, there is a detection method using a back electromotive force (inductive current) generated at a stator-side coil when the motion of rotor for each of the stepping motors 51 and 52 is stopped.

At this time, when electromagnetic noise is superposed on minute back electromotive force, the detection accuracy of the back electromotive force is lowered.

Accordingly, the detection accuracy can be improved by interrupting the PWM control from tm1 to td2 including the waiting period Dd as a detection period of back electromotive force, the tm1 being the start timing to output drive pulses to the stepping motors 51 and 52, and the td2 being the end of detection of back electromotive force after the output of drive pulse is ended.

In the electronic timepiece 1 of the embodiment, the rotor's rotation is detected by the drive circuit 48 measuring the back electromotive force.

When the rotor's rotation cannot be detected within a predetermined period of time, the drive circuit 48 may be configured to drive the stepping motors 51 and 52 again by outputting drive pulses again at a predetermined interval.

Alternatively, the measurement of back electromotive force may be performed by a separately-provided detection section to output the measurement result to the CPU 41 and the drive circuit 48.

Generally, the interruption period is approximately several milliseconds to several tens of milliseconds for one hand.

Here, when a control signal for simultaneously rotating a plurality of hands is output from the CPU 41, in the electronic timepiece 1 of the embodiment, the drive circuit 48 outputs drive pulses by shifting the timings to output the drive pulses to stepping motors corresponding to the respective hands so as not to overlap each other.

The waiting period Dd according to the rotation of each of the plurality of hands is set to be continuous with the drive pulse output period Dm of the following hand which is to be continuously rotated.

Accordingly, when a plurality of hands are simultaneously rotated, the interrupting period of light emitting by the PWM control becomes long according to the number of hands to be rotated.

Figure 6:
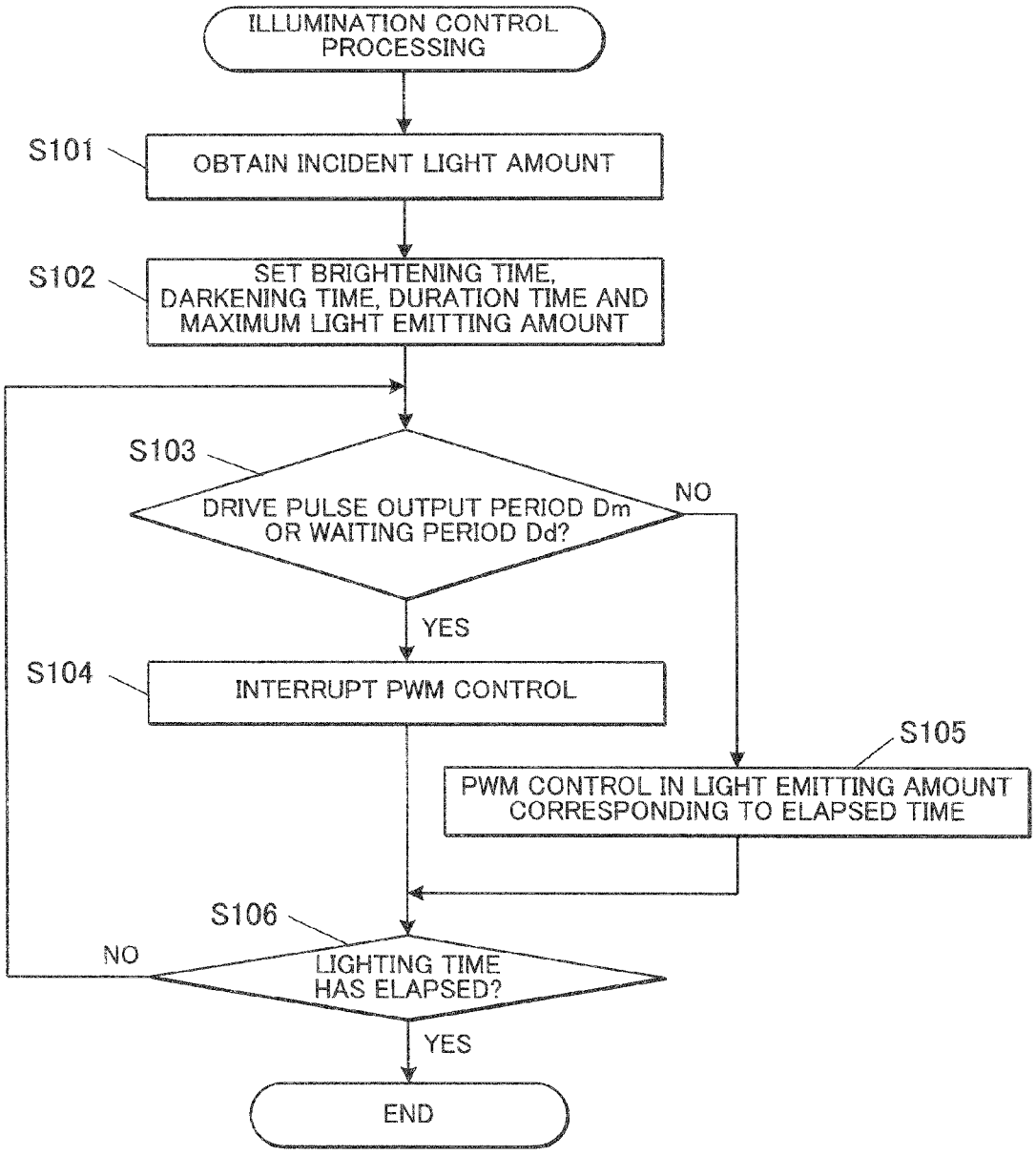
FIG. 6 is a flow chart showing a control procedure of illumination control processing.

FIG. 6 is a flow chart showing a control procedure of illumination control processing executed by the CPU 41 in the electronic timepiece 1 of the embodiment.

The illumination control processing is activated when a lighting instruction is obtained from the user via the operation section 59 and when a light emitting instruction is generated by an internal operation.

When the illumination control processing is started, the CPU 41 obtains the incident light amount which is input from the external light amount detecting section 47 (step S101).

The CPU 41 sets the brightening time when turning on light, the darkening time when turning off light, the maximum light emitting amount and the duration time at the maximum light emitting amount on the basis of the obtained incident light amount (step S102).

The CPU 41 determines whether or not the present time is in the drive pulse output period Dm for outputting drive pulses to a stepping motor according to the hand rotation or the waiting period Dd according to the operation detection of the stepping motor after the drive pulse output period Dm (step S103).

If it is determined that the present time is in the drive pulse output period Dm or the waiting period Dd (step S103: YES), the CPU 41 interrupts the output of control signal according to the lighting control of the light emitting element 55*a* to the illumination section 55 (step S104).

Then, the processing of CPU 41 shifts to step S106.

If it is not determined that the present time is in the drive pulse output period Dm or the waiting period Dd (step S103 NO), the CPU 41 outputs the control signal according to the PWM control for lighting the light emitting element 55*a* at the light emitting amount corresponding to the elapsed time from the start of lighting to the illumination section 55 on the basis of the conditions which were set in step S102 (step S105).

Then, the processing of CPU 41 shifts to step S106.

When the processing shifts to step S106, the CPU 41 determines whether the lighting time of light emitting element 55*a*, that is, a total of the above mentioned brightening time, duration time and the darkening time has elapsed (step S106).

If it is not determined that the lighting time has elapsed (step S106: NO), the processing of CPU 41 returns to step S103. If it is determined that the lighting time has elapsed (step S106: YES), the CPU 41 ends the illumination control processing.

As described above, the electronic timepiece 1 of the embodiment formed of the face 3 and the hands 61 to 63 includes the display section which displays time information and the light emitting element 55*a* which illuminates the display surface of the display section by emitting light. In the electronic timepiece 1, the CPU 41 controls to perform lighting by gradually increasing the light emitting mount of the light emitting element 55*a* to the maximum light emitting amount in a predetermined brightening time according to a predetermined light emitting condition.

Thus, in the electronic timepiece 1, since the light emitting element 55*a* does not suddenly emit light at the maximum light emitting amount in a dark place, it is possible to reduce the dazzle to be felt by the user, and the electronic timepiece 1 can be gentle to user's eyes and ensure good visibility.

Especially, even if the maximum light emitting amount of the light emitting element 55*a* is more than conventional maximum light emitting amounts to improve visibility, the user does not feel the light dazzling more than necessary.

Since the CPU 41 makes the driver 56 vary the light emitting amount of the light emitting element 55*a* by PWM control, it is not necessary to add a hardware configuration for changing light amount, and the light amount can be changed easily and flexibly.

It is also possible to suppress the cost increase according to the manufacturing of the electronic timepiece 1.

The CPU 41 varies at least one of the maximum light emitting amount and the brightening time according to various light emitting conditions including the surrounding environment such as the incident light amount from outside when the light is turned on and the type of instruction such as lighting instruction according to user's operation or lighting instruction according to an internal operation such as alarm notification. Thus, it is possible to effectively use the light of light emitting element 55*a* by lighting the light emitting element 55*a* by an appropriate lighting method or light amount according to the situation.

The electronic timepiece 1 includes the external light amount detecting section 47, and can detect the incident light amount from outside by detecting the electromotive force of solar panel and such like. The CPU 41 can set the maximum light emitting amount to be larger and the brightening time to be shorter as the detected light amount is larger.

By the setting, it is possible to shorten the brightening time and set a sufficient light amount to enable the user perceive the lighting state compared to the incident light amount at an environment where the user does not feel the light dazzling.

Furthermore, it is possible to suppress a part or all of the increase in power consumption due to the increase in maximum light emitting amount by shortening the brightening time.

The electronic timepiece 1 includes the operation section 59 which receives the user's operation. In a case where the instruction to light the light emitting element 55*a* is obtained from the operation section 59, the CPU 41 can set the brightening time longer than that of the case where the light emitting element 55*a* is lighted according to the internal operation in the electronic timepiece 1 such as alarm notification and timer time elapse notification.

Thus, it is possible to change the brightening time between the case of operation, that is, the case where the user has been seeing the display screen when the light emitting element 55*a* is lighted and the case where the user is not seeing the display screen when the lighting of the light emitting element 55*a* is started according to the internal operation.

In a case where the notification operation itself is significant rather than the display content, it is possible to notify the user more effectively by increasing the light emitting amount rapidly.

The electronic timepiece 1 is an analog electronic timepiece which includes a display section including a plurality of hands 61 to 63 and stepping motors 51 and 52 for rotating the hands 61 to 63, and the CPU 41 interrupts the PWM control during the operation period for rotating any one of the plurality of hands 61 to 63 by any one of the stepping motors 51 and 52.

Thus, since it is possible to suppress the generation of the electromagnetic noise due to the change in electric current following the on/off of switch according to PWM control, it is possible to surely operate the stepping motors 51 and 52 and surely confirm the operations of stepping motors 51 and 52.

Since the CPU 41 turns off the light emitting element 55*a* during the interruption of PWM control, it is possible to suppress the power consumption compared to the case where the light emitting element 55*a* is lighted, and suppress the uncomfortable feeling compared to the case of increasing the light emitting amount even in a case where the interruption of PWM control is long and the user can visually confirm the blinking.

The drive circuit 48 measures the back electromotive force after output of the drive pulse to each of the stepping motors 51 and 52 and detects the rotation operation of rotor.

Since the detection period of rotation operation of rotor is included in the above-mentioned operation period for each of the stepping motors 51 and 52, it is possible to prevent the superposition of electromagnetic noise onto the weak back electromotive force and surely confirm the rotation operation of rotor.

The drive circuit 48 controls timings to drive the stepping motors 51 and 52 on the basis of control signals from the CPU 41.

The stepping motor 51 rotates the second hand 61 and the stepping motor 52 rotates the minute hand 62 and the hour hand 63 independently from the second hand 61.

In a case where the timings to rotate at least two hands overlap each other every hour on the hour, for example, the drive circuit 48 shifts the timings so that the operation periods of stepping motors 51 and 52 for rotating the at least two hands, that is, the output periods of drive pulse do not overlap each other, and drives the stepping motors 51 and 52 in order. Accordingly, it is possible to prevent the great load from being placed at one time.

In such case, the PWM control is interrupted over the respective operation periods.

As described above, the operation periods of stepping motors for rotating at least two hands are set to be continuous with each other in a case where the rotation timings of the at least two of the hands 61 to 63 overlap each other. Thus, the interruption periods of the PWM control are set together into a whole.

Accordingly, the hand operation is not unnaturally delayed and the setting of the interruption period of PWM control is not complicated.

The CPU 41 gradually decreases the light emitting amount in the predetermined darkening time to turn off the light after making the light emitting element 55*a* emit the light at maximum light emitting amount over the predetermined duration time.

Accordingly, it is possible to not only reduce the dazzle when increasing the light amount, but also adjust light naturally when increasing or decreasing light.

The present invention is not limited to the above embodiment and various changes can be made.

For example, the PWM control needs not be interrupted during the drive pulse output periods to the stepping motors 51 and 52 in a case where the operations of stepping motors 51 and 52 are not detected, in a case where the influence of electromagnetic noise can be reduced or avoided by performing the detection with a method other than the back electromotive force such as encoder or in a case where the influence of the electromagnetic noise needs not be considered due to the location of the components in the module 5 or an electromagnetic noise shield member.

On the other hand, instead of or in addition to when the stepping motors 51 and 52 are operated, the PWM control can be temporarily interrupted also in a case of performing various operations which possibly generates bad influence of electromagnetic noise such as reception of standard waves according to acquisition of date and time information from outside and radio wave reception from positioning satellites.

During the interruption period of PWM control, the light emitting element 55*a* may be maintained to be turned on instead of being maintained to be turned off.

In such case, either one of turned-off state or turned-on state may be further selected according to the light amount immediately before the interruption.

The above embodiment has been described by illustrating a case where the hands and the face 3 are illuminated from a lateral side by LED illumination; however the light emitting element 55*a* is not limited to the LED and may be others such as an organic light emitting diode (OLED), for example.

The present invention can also be applied to a backlight which illuminates the face 3 not by emitting light from a lateral side but by making an organic EL emit light on the display surface of face 3 or from the opposite side of the display surface of the light permeable face 3.

The above embodiment has been described for an analog electronic timepiece using a plurality of hands; however, the present invention may be applied to a digital electronic timepiece which performs digital display using an LCD or the like.

The above embodiment has been described for the electronic timepiece 1, as an analog electronic timepiece, which is provided with the second hand 61, and the minute hand 62 and hour hand 63 rotated in conjunction with each other; however, all the hands 61 to 63 may be rotated independently, or all the hands 61 to 63 may be rotated in conjunction with each other.

The number of hands is not limited to three, and may be another number.

Similarly, the number of stepping motors is determined according to the number of hands which are independently rotated.

The present invention may also be applied to an electronic timepiece which rotates hands by a means other than stepping motors.

In the embodiment, the light emitting amount is adjusted by PWM control; however, the adjustment can be performed by changing the electric current and voltage input from the power supply section 50 to the light emitting element 55*a*.

For example, the resistance value of resistance element provided in series to the light emitting element 55*a* may be changeable or a plurality of resistance elements having different resistance values may be provided in parallel to each other so that any one of the resistance elements is selectively connected to the light emitting element 55*a* by a switching element to change the partial pressure to be applied to the light emitting element 55*a*.

In the embodiment, the light emitting amount is larger as the detected light amount of external light amount detecting section 47 is larger; however, the light emitting amount can be smaller as the detected light amount is larger, or the light emitting amount may not be changed by the detected light amount.

The light emitting amount can be set not only in two steps but also in arbitrary steps or may be set to be continuous. In a case where the light emitting amount is set continuous, for example, it is possible to perform calculation every time by storing a conversion equation to calculate a setting value of maximum light emitting amount or the like by using, as a variable, the incident light amount or the electromotive force of solar panel.

In the embodiment, the maximum light emitting amount, the brightening time and such like are set according to the detected light amount by the external light amount detecting section 47 and the input operation to the operation section 59; however, the setting may be performed by using other light emitting conditions as a variable such as the inclination angle of display surface detected by an inclination sensor and the movement status of electronic timepiece 1 detected by an acceleration sensor.

Alternatively, the setting may be different between a case of time display and a case of other functional display such as a stopwatch display even for a same operation input by a user.

In the embodiment, the electronic timepiece 1 is operated by power supply from solar electric generation and a secondary cell; however, a primary cell such as a general button type cell may be used.

In this case, for example, an external light amount detecting section 47 which is independent by using a photodiode or the like may be provided unrelated to solar electric generation.

The embodiment has been described for a case where only one light emitting element 55*a* is provided; however, a plurality of light emitting elements 55*a* may be provided.

In this case, the light emitting amounts of the light emitting elements 55*a* may be controlled together by a single control signal or switching element, or separate control signals may be output to the individual switching elements from the CPU 41.

In the embodiment, the light emitting amount is gradually increased when the light is turned on and the light emitting amount is gradually decreased when the light is turned off; however, since the change in light amount when the light is turned off is not related to the reduction of dazzle for a user, the light may be turned off by immediately break down the power supply.

The embodiment has been described by taking, as an example, a light emitting pattern with a large maximum light emitting amount and a short brightening time, and a light emitting pattern with a small maximum light emitting amount and a long brightening time; however, the light emitting pattern is not limited to them.

Only one of the maximum light emitting amount and the brightening time may be changed, or the combination of maximum light emitting amount and brightening time in a pattern may be opposite, that is, the brightening time may be short when the maximum light emitting amount is small, for example.

The other detailed specifics such as specific configurations, shapes, locations, operations and procedures shown in the embodiment can be appropriately changed within the scope of the present invention.

Though several embodiments of the present invention have been described above, the scope of the present invention is not limited to the above embodiments, and includes the scope of inventions, which is described in the scope of claims, and the scope equivalent thereof.

The entire disclosure of Japanese Patent Application No. 2014-132495 filed on Jun. 27, 2014 including description, claims, drawings, and abstract are incorporated herein by reference in its entirety.

What is claimed is:

1. An electronic timepiece, comprising:

a display section which displays time information, the display section including a plurality of hands;

a stepping motor which rotates the hands;

a light emitting section which illuminates a display surface of the display section by emitting light; and a light emitting control section which performs control to turn on the light emitting section by gradually increasing a light emitting amount of the light emitting section to a peak value in a predetermined brightening time according to a predetermined light emitting condition, wherein the light emitting control section varies the light emitting amount of the light emitting section by pulse width modulation control, and the light emitting control section interrupts the pulse width modulation control during an operation period in which one of the plurality of hands is rotated by the stepping motor.

2. The electronic timepiece according to claim 1, wherein the light emitting control section varies at least one of the peak value and the brightening time according to the predetermined light emitting condition.

3. The electronic timepiece according to claim 2, further comprising an external light detecting section which detects a light amount of incident light from outside, wherein the light emitting control section sets the peak value to be larger and the brightening time to be shorter when the detected light amount by the external light detecting section is larger.

4. The electronic timepiece according to claim 2, further comprising an operation section which receives user's operation, wherein, in a case where an instruction to turn on the light emitting section is obtained from the operation section, the light emitting control section sets the brightening time to be longer than a brightening time which is set in a case where the light emitting section is turned on according to an internal operation of the electronic timepiece.

5. The electronic timepiece according to claim 1, wherein the light emitting control section turns off the light emitting section while the pulse width modulation control is interrupted.

6. The electronic timepiece according to claim 1, further comprising an operation detecting section which detects a rotation operation of a rotor of the stepping motor, wherein the operation period includes a detection period of the rotation operation of the rotor.

7. The electronic timepiece according to claim 1, further comprising a drive control section which controls an operation of the stepping motor, wherein:

stepping motors are separately provided to at least two of the plurality of hands and respectively rotate the at least two hands independently, and when rotation timings of the at least two hands overlap, the drive control section drives the stepping motors in order by shifting operation periods of the stepping motors corresponding to the at least two hands so as not to overlap.

8. The electronic timepiece according to claim 7, wherein, when the rotation timings of the at least two hands overlap, the operation periods of the stepping motors corresponding to the at least two hands are set to be continuous with each other.

9. The electronic timepiece according to claim 1, wherein the light emitting control section turns off the light emitting section by gradually decreasing the light emitting amount in a predetermined darkening time after the light emitting control section controls the light emitting section to emit light at the peak value over a predetermined duration time.

* * * * *